United States Patent [19]

Kikuchi et al.

[11] 4,339,315

[45] Jul. 13, 1982

[54] PROCESS FOR PREPARING LITHOGRAPHIC PRINTING PLATE BASES

[75] Inventors: Nobuji Kikuchi, Machida; Yoshiyuki Kisaka; Kazuo Torige, both of Tokyo; Masayuki Onose, Yokohama, all of Japan

[73] Assignee: Mitsubishi Chemical Industries Limited, Tokyo, Japan

[21] Appl. No.: 241,216

[22] Filed: Mar. 6, 1981

[30] Foreign Application Priority Data

Mar. 26, 1980 [JP] Japan ..... 55-38469

[51] Int. Cl.[3] ..... C25F 3/02

[52] U.S. Cl. ..... 204/129.85; 204/129.95

[58] Field of Search ..... 204/129.85, 129.95

[56] References Cited

U.S. PATENT DOCUMENTS 3,975,245 8/1976 Bergquist ..... 204/129.95

4,172,772 10/1979 Ould ..... 204/129.95

*Primary Examiner*—T. M. Tufariello

*Attorney, Agent, or Firm*—Oblon, Fisher, Spivak, McClelland & Maier

[57] ABSTRACT

There is disclosed a process for preparing lithographic printing plate bases, which comprises electrolytically etching a sheet made of aluminum or an aluminum alloy in an aqueous electrolytic solution containing hydrochloric acid and citric or malic acid at a bath temperature of 10° to 40° C.

11 Claims, 2 Drawing Figures x 1200

PROCESS FOR PREPARING LITHOGRAPHIC PRINTING PLATE BASES

BACKGROUND OF THE INVENTION

1. Field of the Invention

This invention relates to a process for preparing lithographic printing plate bases made of aluminum or an aluminum alloy. More specifically, it relates to a process for preparing lithographic printing plate bases which possess a surface superior in hydrophilicity and water retention properties and which has a good adhesion to a photosensitive coating layer provided on the aluminum or aluminum alloy sheet and an outstanding resistance to printing.

2. Description of the Prior Art

One of the base materials for lithographic printing plates which have heretofore been used is aluminum sheets which, in most cases, are grained or roughened prior to use by mechanical polishing, chemical etching, electrolytic etching or similar technique in order to improve their hydrophilicity for dampening water used in printing procedure, water retention properties and adhesion to a photosensitive coating layer provided thereon.

The surface topographies of the grained aluminum sheets greatly contribute to the plate making performance of the coated sheets as printing plates. Therefore it is highly important to control the surface topographies of the grained aluminum sheets.

For instance, those grained surface in which relatively fine, shallow pits are present densely are suitable as printing plate bases for use on a proof press for which a good image reproducibility and a high resolving power are required. On the other hand, those grained surface in which the pits are deep and uniform in diameter (uniform microscopically) are suitable as printing plate bases for use on a regular press for which a marked water retention and a high resistance to printing are required.

Among various graining techniques, particularly electrolytic etching techniques have attracted attention in recent years because it makes possible the production of a wide variety of grained surface varying from a relatively fine, shallow grain to a deep and uniform one, as compared with mechanical polishing techniques including ball polishing and brush polishing and chemical etching techniques.

In the elctrolytic etching process, an aluminum sheet is generally immersed in a suitable electrolyte solution and electrolyzed with direct or alternating current to grain the surface.

The most well-known electrolyte for this purpose is hydrochloric acid. However, when hydrochloric acid is used in electrolytic etching of an aluminum sheet, it is difficult to produce deep grains which are uniform in microscopic topography (e.g., topography observed under magnification to 100 to 1,200 diameter on a microscope or the like.) Therefore, particularly when used as printing plate bases for use on a regular press, these bases are not always satisfactory in adhesion properties of the coating layer in the image area and in resistance to printing, although they are superior in water retention properties and in removability of the coating layer in the non-image area during developing process.

Accordingly, there is a continuing need for a lithographic printing base which is superior in water retention and resistance to printing.

SUMMARY OF THE INVENTION

Thus, in brief, the present invention resides in a process for preparing lithographic printing plate bases, which comprises electrolytically etching a sheet made of aluminum or an aluminum alloy in an aqueous electrolytic solution containing hydrochloric acid and citric or malic acid at a bath temperature of 10° to 40° C.

DETAILED DESCRIPTION OF THE PREFERRED EMBODIMENTS

Figure 1:
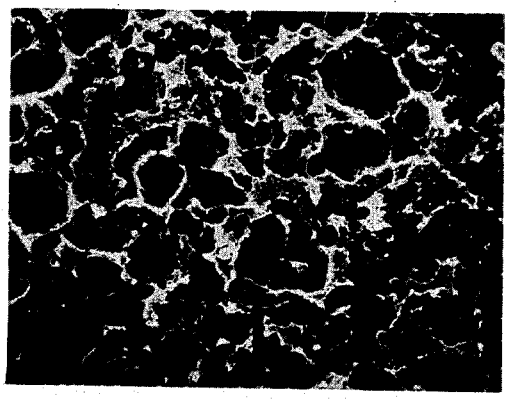
FIG. 1 is a photograph on a scanning electron microscope at 1,200 magnifications of the surface of an aluminum sheet which is electrolytically etched in an aqueous elctrolytic solution containing 0.5 mole/l of hydrochloric acid at a bath temperature of 25° C.

The aluminum sheet to which the process of the present invention is applied may be a pure aluminum sheet or a sheet of an aluminum alloy which consists of a predominant amount of aluminum and a minor amount or amounts of one or more metals such as silicon, magnesium, iron, copper, zinc, manganese, chromium, etc.

Since the surface of the sheet of aluminum or aluminum alloy (hereinafter referred to as "aluminum sheet") is contaminated with grease, rust, dust and the like, the aluminum sheet is desirably degreased and cleansed in a conventional manner prior to electrolytic etching. For example, the aluminum sheet may be subjected to solvent degreasing with trichlene, thinner, etc. and/or emulsion degreasing with a combination of kerosine and triethanolamine, etc., then immersed in an aqueous sodium hydroxide solution of 1 to 10% concentration at 20° to 70° C. for 5 seconds to 10 minutes to remove such contaminants that cannot be removed by degreasing alone and natural oxide layer, and finally immersed in an aqueous nitric or sulfuric acid solution of 10 to 20% concentration at 10° to 50° C. for 5 seconds to 5 minutes for the purpose of neutralization after the alkali etching and removal of smuts.

In accordance with the invention, the aluminum sheet is electrolytically etched at a bath temperature of 10° to 40° C. in an aqueous electrolytic solution which contains hydrochloric acid and citric or malic acid. Usually, the electrolytic solution contains 0.1 to 1 mole/l, preferably 0.2 to 0.6 mole/l of hydrochloric acid and 0.01 to 1 mole/l, preferably 0.04 to 0.5 mole/l of citric or malic acid.

An excessively high concentration of hydrochloric acid tends to cause the formation of smuts as well as the formation of grains which is not uniform in macroscopic surface appearance. For this reason, it is preferred that the concentration of hydrochloric acid be not greater than 1 mole/l.

On the other hand, if the concentration of hydrochloric acid is too low, the pits produced by eletrolytic etching do not become microscopically uniform so that it is preferably not lower than 0.1 mole/l.

Citric acid and malic acid have the effect of controlling pit growth and provide a base having deep grains with relatively small pit diameters. The concentration of citric or malic acid is preferably not greater than 1 mole/l since excessively high concentrations increase the effect of controlling the etching to such an extent that an excessively high current density must be used to produce proper grains. On the other hand, if the concentration of citric or malic acid is too low, it is impossible to produce the desired grains of relatively small pit diameter. Hence, the concentration of citric or malic acid is preferably not lower than 0.01 mole/l.

When the temperature of the electrolyte exceeds 40° C., those pits having extraordinary large diameters are formed sporadically and the grains formed are not microscopically uniform. Therefore the temperature is preferably 40° C. or below, more preferably in the range of 10° to 30° C.

The current density varies with the desired depth of grains and is usually in the range of 20 to 200 A/dm$^2$, preferably in the range of 50 to 150 A/dm$^2$.

When an aluminum sheet is electrolytically etched under the above-mentioned conditions, the grains produced are suitable for use as printing plates in that the diameter (average diameter) of the pits is uniform on the order of 2 to 7 microns and that the pits are present sufficiently close to each other to minimize the area of flat plateau-like surface.

The electrolytic etching according to the present invention can be conducted either batchwise or continuously. The continuous process can be performed, for example, by passing an aluminum web continuously through an electrolytic cell.

The electrolytically etched aluminum sheet may be desmutted, as required, by immersing in an aqueous solution of an alkali or acid at a temperature of from room temperature to 80° C. for 1 to 5 minutes and then neutralized in a conventional manner prior to use as a printing plate base. It is a matter of course that prior to use the aluminum sheet may be subjected to anodic oxidation in a conventional manner. This is conducted by electrolysis in an aqueous solution of sulfuric acid, phosphoric acid or the like of 10 to 50% concentration at a current density of 1 to 10 A/dm$^2$. After anodization, the aluminum sheet may be further subjected to sealing or made hydrophilic, as required, using hot water or a silicate, dichromate, acetate, hydrophilic polymeric compound or the like.

The type of photosensitive materials which can be applied to the aluminum sheet treated as above in accordance with the present invention is not critical, and any of various known materials may be used. Exemplary of these materials are compositions of a hydrophilic polymer and a diazonium salt, diazo compounds such as diazodiphenylamine, compositions of a quinonediazide compound and an alkali-soluble resin, a polymer of unsaturated carboxylic acids dimerizable by irradiation with active radiation (e.g., a polymer of cinnamic acid or phenylenediacrylic acid), compositions of a compound polymerizable by irradiation with active radiation and a polymeric binder, azide compounds and the like.

A photosensitive lithographic printing plate can be prepared by dissolving a photosensitive material as above in a suitable solvent together with one or more of various known additives, then applying the solution to an aluminum sheet prepared in accordance with the present invention, and drying the coated sheet. The photosensitive lithographic printing plate thus prepared can afford a printing plate which is excellent in hydrophilicity and water retention and which is also excellent in resistance to printing due to extremely strong adhesion between the photosensitive material in the image area and the aluminum sheet base, when an original is placed on the printing plate and the plate is exposed and developed in a conventional manner.

Having generally described the invention, a further understanding can be obtained by reference to certain specific examples which are provided herein for purpose of illustration only and are not intended to be limiting unless otherwise specified.

EXAMPLE 1

A 0.3 mm-thick aluminum sheet (Alloy Designations 1050, Temper H16) was immersed in an aqueous 1% sodium hydroxide solution at 50° C. for a minute to effect alkali etching, and then washed with water. Thereafter it was further immersed in 10% nitric acid at 25° C. for a minute for the purpose of neutralization and desmutting, and then washed with water.

The aluminum sheet is then subjected to electrolytic etching under the conditions indicated in Table 1 below, thereby providing in each working example a grained sheet having a uniform pit diameter as compared with the comparative examples.

Figure 2:
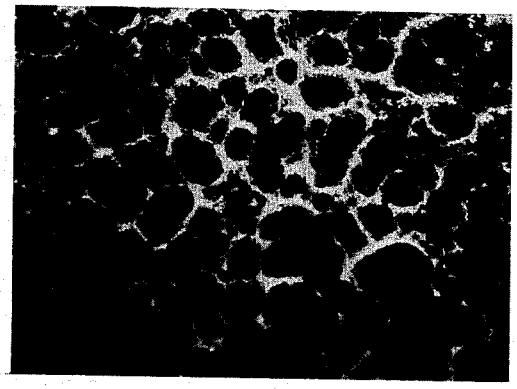
FIG. 2 is a photograph on a scanning electron microscope at 1,200 magnifications of the surface of an aluminum sheet which is electrolytically etched in an aqueous electrolytic solution containing 0.5 mole/l of hydrochloric acid and 0.25 mole/l of citric acid at a bath temperature of 25° C.

Electron micrographs of the surface topographies of the sheets of No. 1 (comparative example) and No. 10 (working example) of Table 1 under a scanning electron microscope are shown in FIGS. 1 and 2, respectively.

TABLE 1

| No.* | Composition of electrolytic solution: HCl (Mole/l) | Citric acid (Mole/l) | Malic acid (Mole/l) | Temp. (°C.) | Current density (A/dm$^2$) | Time (sec.) | Average roughness (μ) | (a) Microscopic topography | (b) Macroscopic surface appearance |
|---|---|---|---|---|---|---|---|---|---|
| 1 | 0.5 | — | — | 25 | 50 | 30 | 0.73 | X | ○ |
| 2 | " | — | — | " | 100 | 20 | 1.28 | X | ○ |
| 3 | 0.8 | — | — | " | 80 | " | 0.23 | X | X |
| 4 | " | — | — | " | 100 | ' | 0.82 | X | X |
| 5 | 0.3 | 0.1 | — | " | 60 | 20 | 0.87 | ○ | ○ |
| 6 | " | " | — | " | 90 | " | 1.01 | ○ | ○ |
| 7 | " | 0.5 | — | " | 60 | " | 0.22 | ○ | ○ |
| 8 | " | " | — | " | 90 | " | 0.32 | ○ | ○ |
| 9 | 0.5 | 0.25 | — | " | 80 | " | 0.70 | ○ | ○ |
| 10 | " | " | — | " | 100 | " | 0.73 | ○ | ○ |
| 11 | " | 0.5 | — | " | 50 | 30 | 0.50 | ○ | ○ |
| 12 | " | " | — | " | 80 | 20 | 0.61 | ○ | ○ |
| 13 | 0.8 | 0.05 | — | " | 90 | " | 0.37 | ○ | ○ |
| 14 | " | 0.1 | — | " | " | " | 0.29 | ○ | ○ |
| 15 | " | 0.5 | — | " | " | " | 0.27 | ○ | ○ |
| 16 | 0.5 | — | 0.05 | " | " | " | 0.90 | ○ | ○ |

TABLE 1-continued

| No.* | Composition of electrolytic solution HCl (Mole/l) | Citric acid (Mole/l) | Malic acid (Mole/l) | Temp. (°C.) | Current density (A/dm²) | Time (sec.) | Average roughness (μ) | (a) Microscopic topography | (b) Macroscopic surface appearance |
|---|---|---|---|---|---|---|---|---|---|
| 17 | " | — | 0.1 | " | " | " | 0.73 | ○ | ○ |
| 18 | " | — | 0.5 | " | " | " | 0.45 | ○ | ○ |
| 19 | 0.8 | — | 0.05 | " | " | " | 0.43 | ○ | ○ |
| 20 | " | — | 0.1 | " | " | " | 0.52 | ○ | ○ |
| 21 | " | — | 0.5 | " | " | " | 0.37 | ○ | ○ |
| 22 | 0.5 | 0.5 | — | 50 | 60 | 20 | 0.70 | X | Δ |
| 23 | " | " | — | " | 90 | " | 0.55 | Δ | Δ |

*No. 5–21: working examples, No. 1–4, 22, 23: comparative examples
(a) Microscopic topographies are those observed under magnification to 1,200 diameters using a scanning electron microscope.
○ - good (uniform)
Δ - relatively poor (relatively non-uniform)
X - poor (non-uniform)
(b) Macroscopic surface appearances are the visually observed surface conditions of the grained sheet.
○ - good (even)
Δ - relatively poor (relatively uneven)
X - poor (uneven)

EXAMPLE 2

The electrolytically etched grained sheets of No. 1 (comparative example) and No. 10 (working example) of Example 1 were subsequently desmutted in an aqueous 5% sodium hydroxide solution at 60° C. for 10 seconds, then anodized in 20% sulfuric acid at 25° C. and 6 A/dm² for 30 seconds and coated with an o-quinonediazide-type sensitizing solution to prepare printing plates.

The plates were exposed through a positive transparency and developed. When the printing plate obtained with the sheet of the working example (No. 10) was used in offset printing, it exhibited a superior hydrophilicity and water retention and was easy of printing. It was still in a printable condition after 200,000 impressions had been printed therewith.

The printing plate obtained with the sheet of comparative example (No. 1) was also used in printing under the same conditions. In this case, however, after printing of 100,000 impressions, a portion of the image area peeled off, which caused the ink to adhere badly, and it was impossible to continue the printing any further.

EXAMPLE 3

In a continuous process, an aluminum web (Alloy Designations 1050, Temper H16) was pretreated by alkali etching in an aqueous 1% sodium hydroxide solution, water rinsing, neutralization and water rinsing, and then electrolytically etched under the conditions indicated in Table 2 below.

In each run, a grained sheet having uniform pit diameters was obtained. The grained sheets were subsequently desmutted in 5% sodium hydroxide solution at 60° C. for 10 seconds, then anodized in 20% sulfuric acid at 25° C. and 6 A/dm² for 30 seconds and coated with an o-quinonediazide-type sensitizing solution in the same way as in Example 2 to prepare printing plates.

These plates were exposed through a positive transparency and developed. When the printing plates made as above were used in offset printing, they exhibited a superior hydrophilicity and water retention, were easy of printing and were still in a printable condition after 200,000 impressions had been printed, as is the case with the sheet of No. 10 of Example 2.

TABLE 2

| No. | Composition of electrolytic solution HCl (mole/l) | Citric acid (mole/l) | Temp. (°C.) | Current density (A/dm²) | Time (sec.) | Average roughness (μ) | Microscopic topography | Macroscopic surface appearance |
|---|---|---|---|---|---|---|---|---|
| 24 | 0.3 | 0.08 | 25 | 80 | 20 | 0.91 | ○ | ○ |
| 25 | " | 0.17 | " | 85 | " | 0.94 | ○ | ○ |
| 26 | " | 0.25 | " | 90 | " | 0.86 | ○ | ○ |

Having now fully described this invention, it will be apparent to one of ordinary skill in the art that many changes and modifications can be made thereto without departing from the spirit or scope of the invention as set forth herein.

What is claimed as new and intended to be covered by Letters Patent is:

1. A process for preparing lithographic printing plate bases, which comprises electrolytically etching a sheet made of aluminum or an aluminum alloy in an aqueous electrolytic solution containing 0.1 to 1 mole/l of hydrochloric acid and 0.01 to 1 mole/l of citric or malic at a bath temperature of 10° to 40° C.

2. The process according to claim 1, wherein the aqueous electrolytic solution contains hydrochloric acid and citric acid.

3. The process according to claim 1, wherein the aqueous electrolytic solution contains hydrochloric acid and malic acid.

4. The process according to claim 1, wherein the bath temperature is in the range of 10° to 30° C.

5. The process according to claim 1, wherein the sheet is electrolytically etched at a current density of 20 to 200 A/dm².

6. A process for preparing lithographic printing plate bases, which comprises electrolytically etching a sheet made of aluminum or an aluminum alloy in an aqueous electrolytic solution containing 0.1 to 1 mole/l of hydrochloric and 0.01 to 1 mole/l of citric or malic acid at a bath temperature of 10° to 40° C., and thereafter anodizing the sheet in an aqueous electrolytic solution containing sulfuric acid or phosphoric acid.

7. The process according to claim 6, wherein the etched sheet is anodized at a current density of 1 to 10 $A/dm^2$.

8. The process according to claim 6, wherein the concentration of sulfuric acid or phosphoric acid is in the range of 10 to 50%.

9. A lithographic printing plate base prepared by the process of claim 1.

10. A lithographic printing plate base prepared by the process of claim 6.

11. A lithographic printing plate prepared by the process of claim 5.

* * * * *